US006618971B2

(12) United States Patent
Ingram et al.

(10) Patent No.: US 6,618,971 B2
(45) Date of Patent: Sep. 16, 2003

(54) ROTARY CARD HOLDER

(75) Inventors: Jack Ingram, Leamington Spa (GB); Simon Richard Andrews, Birmingham (GB)

(73) Assignee: Rotadex Systems Limited (GB)

( * ) Notice: Subject to any disclaimer, the term of this patent is extended or adjusted under 35 U.S.C. 154(b) by 0 days.

(21) Appl. No.: 10/050,355

(22) Filed: Jan. 16, 2002

(65) Prior Publication Data

US 2002/0092217 A1 Jul. 18, 2002

(30) Foreign Application Priority Data

Jan. 16, 2001 (GB) ..... 0101085

(51) Int. Cl.[7] ..... A47B 49/00
(52) U.S. Cl. ..... 40/377; 40/390; 40/404
(58) Field of Search ..... 40/390, 377, 373, 40/376, 379, 404, 493, 494

(56) References Cited

U.S. PATENT DOCUMENTS

| | | | | | |
|---|---|---|---|---|---|
| 2,589,383 A | | 3/1952 | Holt | | |
| 3,071,426 A | | 1/1963 | Wassell | | |
| 3,890,727 A | * | 6/1975 | Rose | ..... | 40/379 |
| 4,035,938 A | * | 7/1977 | Neilsen | ..... | 40/379 |
| 4,165,575 A | * | 8/1979 | Neilsen | ..... | 40/379 |
| 4,270,289 A | * | 6/1981 | Kimura | ..... | 40/379 |
| 4,599,815 A | * | 7/1986 | Waldo | ..... | 40/377 |
| 5,307,926 A | | 5/1994 | Mee | | |

FOREIGN PATENT DOCUMENTS

| | | |
|---|---|---|
| BE | 452236 | 5/1954 |
| GB | 827915 | 2/1960 |
| GB | 2255218 | 10/1992 |

* cited by examiner

*Primary Examiner*—Gary Hoge
(74) *Attorney, Agent, or Firm*—Trexler, Bushnell, Giangiori, Blackstone & Marr, Ltd.

(57) ABSTRACT

A rotary card holder comprises a rotary card wheel, which at its respective opposite ends is non-rotatably secured to hand wheels, with a stationary axle, about which the card wheel rotates, extending through the card wheel and the hand wheels and having secured non-rotatably to its opposite ends respective end caps with which respective free ends of a wire support frame are non-rotatably secured. Each end cap carries a flexible polypropylene strip which has a free end extending from the periphery thereof to engage in a selected one of a series of grooves in the inside periphery of the hand wheels. In this way the card wheel is retained in its adjusted position each time it is adjusted and a 'clicking' indication is produced during adjustment.

43 Claims, 4 Drawing Sheets

ROTARY CARD HOLDER

Figure 1:
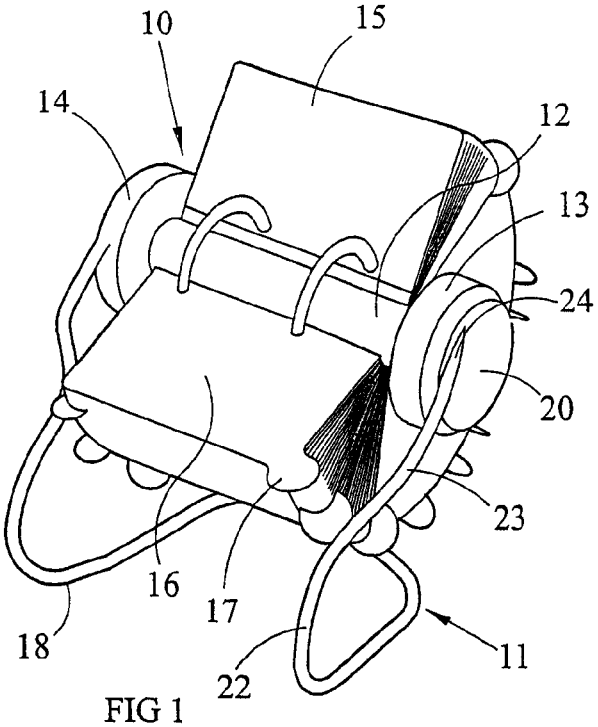

This invention relates to a rotary card holder having a rotary member in the form of a card wheel which is manually rotatable about a horizontal axis and carries a multiplicity of loosely mounted cards which contain information such as names, addresses and telephone numbers. The cards are sequentially presented to the view of a user as the card wheel is rotated, and are conveniently arranged with the information in some order, for example alphabetically.

It is known with such a rotary card holder to provide means for retaining the card wheel in the position to which it has been turned, against, for example, the force of gravity acting on the greater number of cards which are on one side of the wheel than the other. Moreover in moving the wheel from one retained position to another, there is normally heard an associated audible indication, typically a clicking sound.

An object of the invention is to provide a rotary card index in an effective and convenient manner.

According to the invention, a rotary card holder comprises a rotary member mounted by a support assembly for rotation relative thereto and having means for holding a plurality of cards, in use, manually operable means for turning the rotary member, and flexible means, between the support assembly and said manually operable means or said rotary member, the flexible means retaining the rotary member in a position to which it has been turned, in use, by said manually operable means, and/or producing an audible indication as the rotary member turns, in use.

As used herein, the term 'cards' includes not only conventional index cards and dividers, but also equivalently notched holders, for example for business cards.

Preferably the manually operable means is a hand wheel non-rotatably fixed to the rotary member. Desirably the hand wheel is at one end of the rotary member and at its side remote from said one end there is part of said support assembly, said flexible means acting between said hand wheel and said part of the support assembly. Conveniently said part of the support assembly is an end cap which protrudes into an outer open side of the hand wheel, and advantageously has said flexible means fitted at an inner side thereof received within said hand wheel. More preferably the flexible means is a polypropylene strip and most preferably it has a free end which interferes with projections around an inner periphery of the hand wheel, when the rotary member is turned, in use, by the hand wheel, to produce said audible indication. Said free end of the strip is disposed between a pair of adjacent ones of said projections when it retains the rotary means in a position to which it has been turned, in use. More conveniently the strip is folded into a V-shape to provide two such free ends, which are disposed between respective pairs of adjacent ones of said projections to retain the rotary member in an adjusted position.

The support assembly more desirably comprises a wire frame, and in one embodiment it has respective free ends engaged with respective end caps at opposite ends of the rotary member.

Figure 2:
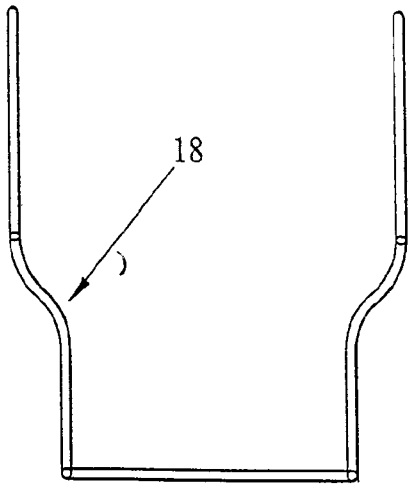
Figure 4:
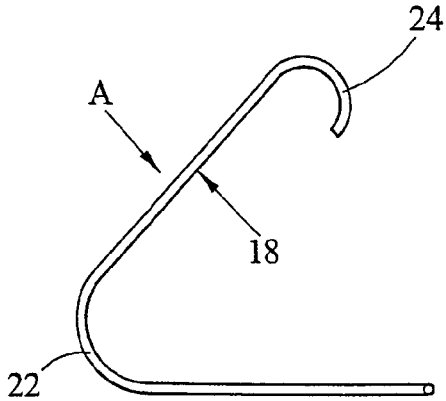
Figure 3:
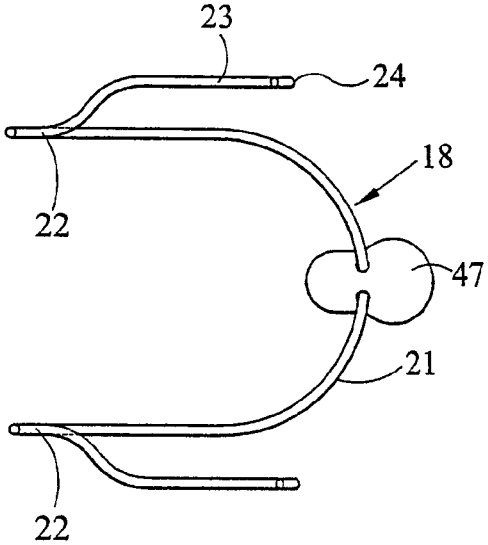
Figure 5:
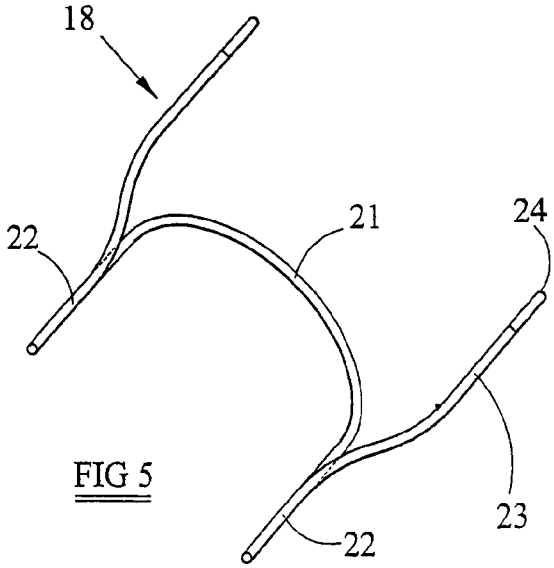
Figure 6:
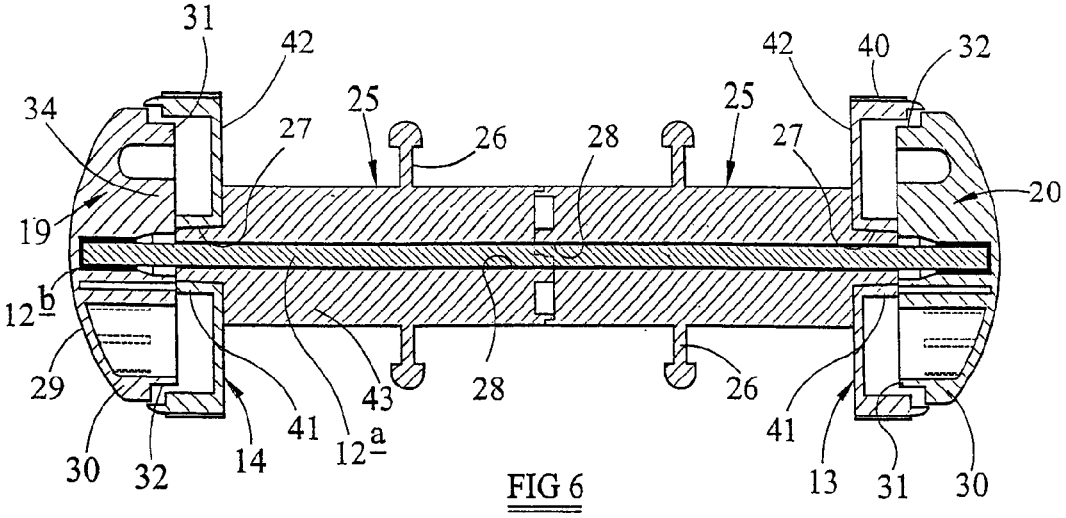
Figure 7:
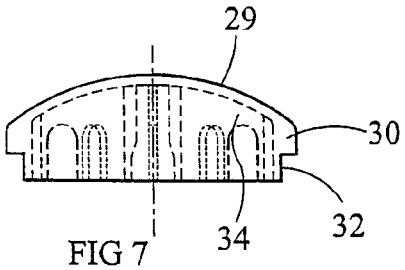
Figure 8:
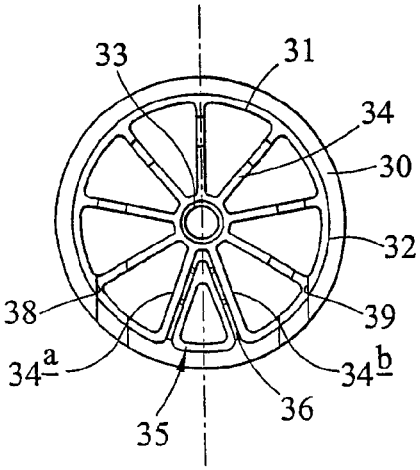
Figure 10:
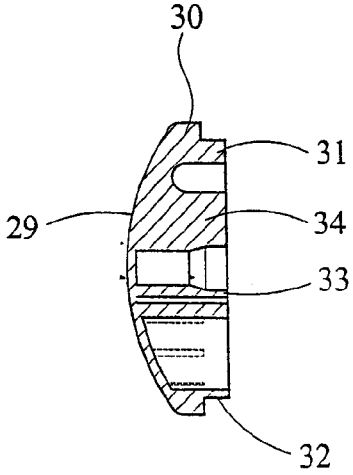
Figure 9:
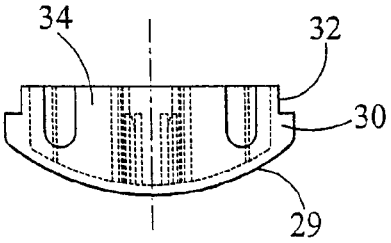
Figure 11:
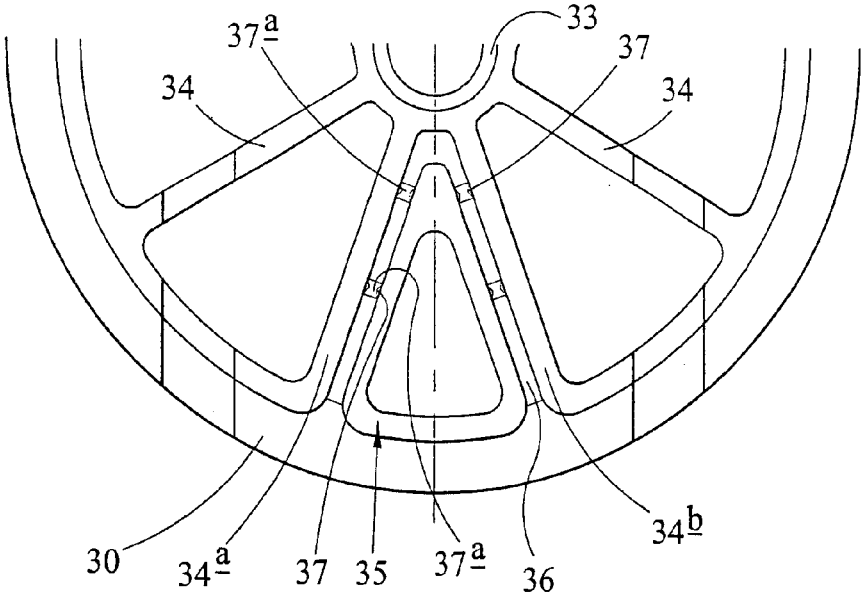
Figure 12:
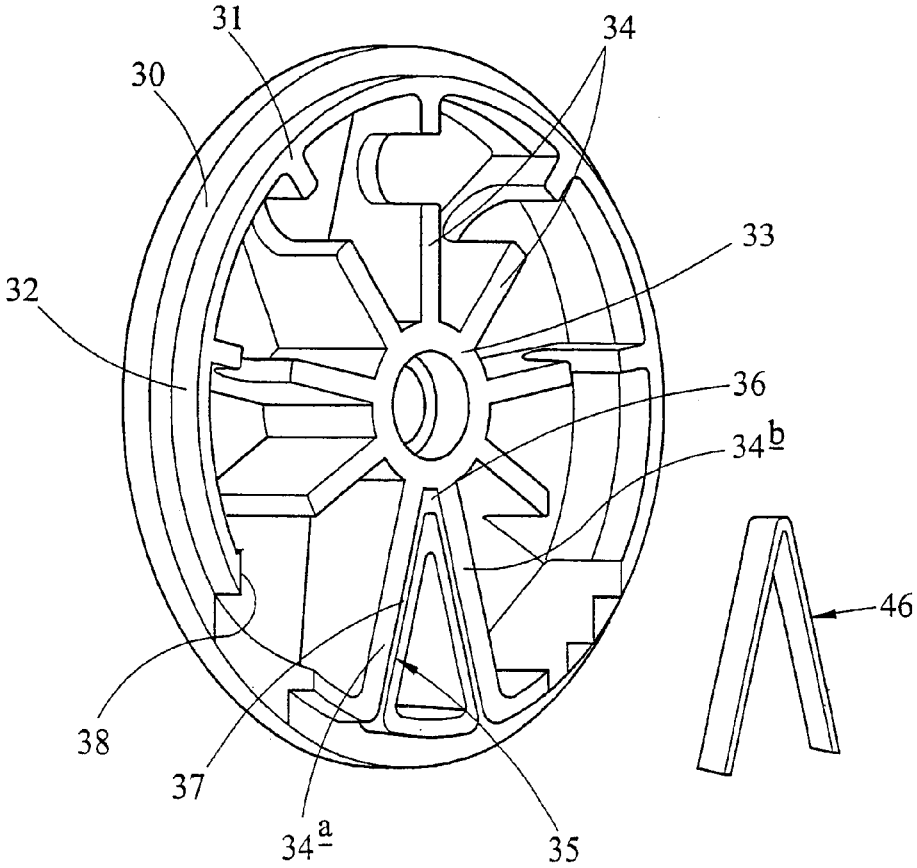
Figure 13:
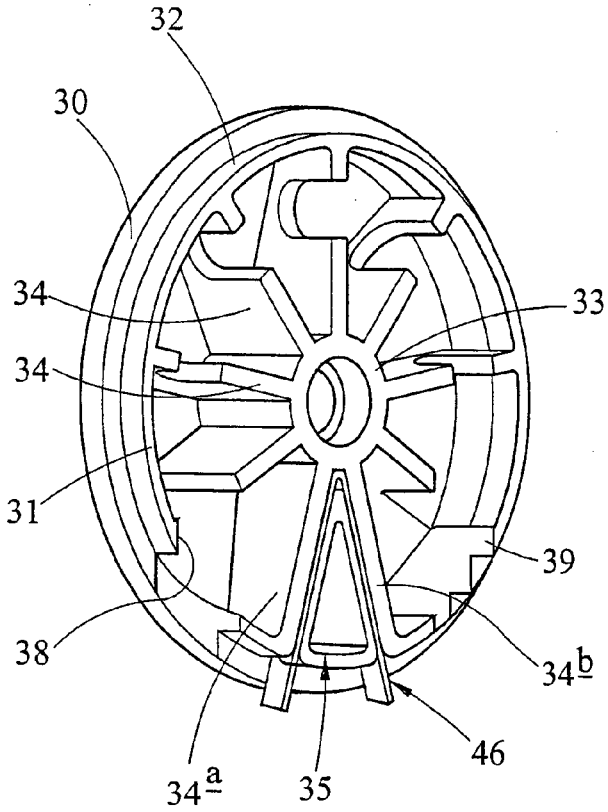
Figure 14:
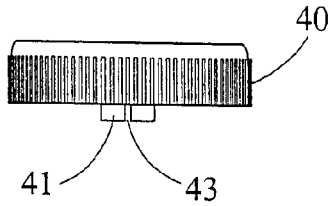
Figure 15:
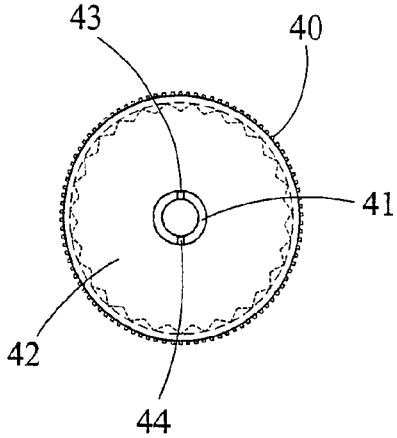
Figure 16:
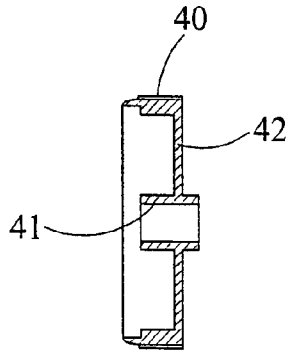
Figure 17:
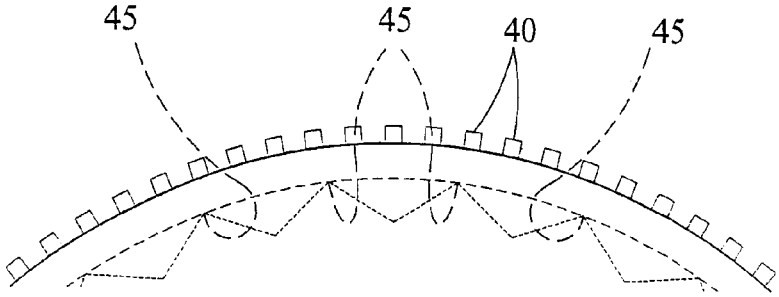

The invention will now be described, by way of example, with reference to the accompanying drawings, in which:

FIG. 1 is a perspective view of a rotary card holder of the invention, showing a multiplicity of cards held thereby, FIGS. 2 to 4 are respectively a front view, a top view and a side view of a wire frame of a support assembly of the rotary card holder of FIG. 1, FIG. 5 is a view in the direction of arrow A in FIG. 4, FIG. 6 is a cross-section of part of the rotary card holder, showing rotary means, hand wheels at respective opposite ends of the rotary means, for manually turning the rotary means, and end caps at respective hand wheels, FIGS. 7 to 10 respectively are a top view, a rear view, an underneath view and a cross-sectional view of an end cap of FIG. 6, FIG. 11 is an enlarged, scrap rear view of part of the end cap, FIG. 12 is an enlarged, rear perspective view of the end cap, also showing flexible strip means for fitting thereto, FIG. 13 is a view like FIG. 12, showing the strip fitted in place, FIGS. 14 to 16 are respectively a top view, a rear view and a cross-sectional view of a hand wheel of FIG. 6, and FIG. 17 is an enlarged, scrap rear view of part of the hand wheel.

One embodiment of a rotary card holder 10 of the invention is shown in FIG. 1. As can be seen therefrom, the holder 10 comprises a support assembly, denoted generally by the numeral 11, which mounts, for rotation about a horizontal axis, in use, a rotary card wheel 12, which at its respective opposite ends has manually operable hand wheels 13, 14 for turning the card wheel 12 to present different ones of the cards 15 carried on the wheel 12 to be presented in an upright disposition to the user. As can be seen from FIG. 1, different series of cards 15 can be separated by suitable dividers 16 also carried on the wheel 12, these being identified by respective tabs 17 along their longer outer edge. The support assembly 11 comprises a configurated wire frame 18 together with a pair of end caps 19, 20 respectively at the opposite free ends of the frame 18, with an axle 12*a* connecting the two end caps together and extending through the card wheel 12 which turns thereon.

The frame 18, which is preferably formed of chrome-plated 5 mm mild steel wire or rod, is configurated as shown in FIGS. 2 to 5, the frame being symmetrical about a longitudinal central axis thereof. Instead of wire or rod, the frame could be tubular.

Accordingly it can be seen that the frame is formed with a relatively large U-shaped base portion 21, which is received, in use, on the surface which supports the holder. At the free end of each arm of the U-shaped portion 21 there is an upwardly extending smaller generally C-shaped portion 22, which as it extends further upwardly from its associated leg of the base portion 21 is deformed sidewardly and outwardly as shown best in FIG. 3. From the end of the portion 22 remote from the base portion 21, there then extends an upwardly curving portion 23 which has a hooked end 24 as shown best in FIG. 4. As described, the frame 18 is symmetrical so that the portions 22 to 24 described at one side of the frame are mirrored at the opposite side thereof.

As will be explained hereinafter, the hooked ends 24 of the frame 18 engage with the respective end caps 19, 20 which are outermost at the respective opposite sides of the holder 10, so that, in contrast to known rotary card holder arrangements, the hand wheels 13, 14, are disposed inwardly of the respective opposite sides of the frame at the rotary card wheel.

FIG. 6 shows the general assembly of the card wheel 12, hand wheels 13, 14 and end caps 19, 20.

The card wheel 12 is, in this embodiment, formed by two separate identical half-wheels 25. Each half-wheel is generally cylindrical and substantially hollow, being formed of injection moulded translucent polystyrene. Each half-wheel 25 is formed at one of its ends with an arrangement of recesses and projections, and in this way when the two half-wheels 25 are placed together as shown in FIG. 6, with these ends respectively abutting, but with one half-wheel displaced angularly relative to the other one, these ends interfit, as shown in FIG. 6, to form the composite card wheel 12. From FIG. 6 it can be seen that the conventional form of annular hard holding projection 26 is integrally formed on the exterior surface of each half-wheel 25, this projection extending radially therefrom around said exterior surface. In this way the respective projections 26 on the two half-wheels 25 are spaced apart by the distance corresponding to the spacing apart of the pair of notches in each of the cards 15 or dividers 16. Although the nature and construction of the card wheel does not form part of the present invention, it will of course be appreciated that this can be of any convenient form and can, for example, be wholly conventional. However in one embodiment of a card wheel of the invention, it could be arranged that the half-wheels are reversible so as to alter the spacing between the pair of card holding projections so as to allow the use of different cards with the rotary card holder.

As can be seen from FIG. 6, the other end of each half-wheel 25 is formed with a central, coaxial spigot 27 which is of reducing diameter towards its free end. Each half-wheel 25 has a central circular section bore 28 therethrough, each bore extending through the spigot 27 and defining a central longitudinal axis of the card wheel 12. The section shown in FIG. 6 is through upper and lower flanges in each of the half wheels.

As can be seen from FIGS. 6 to 13, each end cap 19, 20 is in the form of a knob having an outer generally convex surface 29 which merges with a short cylindrical outer wall section 30 which is stepped down as it extends away from the surface 29 to form an annular flange 31, the stepping down defining an outwardly facing annular surface 32 thereof, and the flange 31 being at the inner free end of the end cap. Each end cap, like each half-wheel 25, is preferably formed of injection moulded polystyrene.

Within the annular flange 31, each end cap is formed with a central cylindrical hub part 33 from which a series of angularly spaced ribs 34 radially extend to the flange 31. As shown in the drawings, there are, in this embodiment, nine ribs 34 generally equi-angularly spaced around the hub part 33. For one pair of adjacent ribs 34, denoted by the numerals 34*a* and 34*b*, each rib, at its outer end, merges with the flange 31 rather than extending thereto. As a consequence the angular rib 31 is interrupted between these two ribs 34*a* and 34*b*. However as best shown in FIG. 11, the space between these ribs contains a projection 35 in the form of an isosceles triangle, which, as shown best in FIGS. 12 and 13, has the same axial depth as the ribs 34*a* and 34*b*. However the projection is sized so as not to fill the space between these ribs, but to leave a channel 36 of inverted V-shape around the projection 35 with the two ribs lying parallel to the respective equi-length sides of the projection 35. In each limb of the V-shaped channel, integral small elongated projections, pips or the like 37 are provided at opposite sides thereof, i.e. on the side of the projection and facingly on the side of the rib, for a purpose to be described hereinafter. These pips 37 can be of any suitable form, could be arranged at one side of each limb only or could be staggered alternatingly on the two facing sides. Between each pair of pips 37 is a support column 37*a* which terminates short of the outer ends of the pips to provide a flat location/support, also for a purpose to be described hereinafter.

It can also be seen from the Figures, and in particular from FIG. 13, that at respective equal angles from the outer sides of said ribs 34*a* and 34*b*, the flange 31 is interrupted by respective straight openings 38, 39 which are parallel to one another and to a plane bisecting said projection 35. Finally with regard to the structure of an end cap, it can be seen from FIG. 6 that the bore within the hub part 33 is stepped downwardly towards its blind end. Within this bore is received a friction cap 12*b* to engage the end of the circular-section axle 12*a* which has its opposite ends received in said friction caps in the end caps respectively and extends through the intervening card wheel 12 formed by the two half-wheels 25, so that this axle is non-rotatably held by the end caps, which are part of the stationary frame assembly, the hand wheels 13, 14 and the card wheel 12 being turned, in use, about said axle and thus relative to the axle and said end caps.

As can be seen to some degree from FIG. 1, the frame 18 engages each of the end caps by virtue of its hooked end 24 being received around the outer surface of the flange 31 and with its inwardly directed terminal portions of the hooked ends 24 extending through one of the openings 38, 39 for the respective end caps 19, 20. By providing two such openings, symmetrically at opposite sides of the pair of ribs 34*a* and 34*b*, it is ensured that the two end caps are interchangeable, i.e. can be used at either end of the card wheel. Thus for the frame 18, one of its terminal end parts will extend through an opening 38 in one end cap, while its other terminal end will extend through an opening 39 in the other end cap, thereby making it unnecessary to produce the end caps in handed form. The 'springiness' of the wire forming the frame 18 and the radius of curvature of each hooked end relative to the flanges 31, is such that it is ensured that the frame is a close fit on each end cap.

Each of the hand wheels 13, 14 is also preferably formed of injection moulded, translucent polystyrene and is in the form of a generally cylindrical wheel or knob which has knurling 40 around its outer periphery to enable it to be manually gripped and rotated, as previously described, in order to turn the card wheel 12. As can be seen from FIGS. 6 and 14 to 16 inclusive, each hand wheel has a generally hollow interior, and at its centre there is a circular hollow boss 41 which extends to both sides of the cylindrical wall 42 which, in use, as shown in FIG. 6, forms an inner wall for each hand wheel in that it is against this wall that one of the half-wheels 25 abuts.

As can be seen from FIG. 6, each of the hand wheels is fitted to an associated one of the half-wheels 25 by virtue of the spigot 27 of the half-wheel 25 being received as a tight fit within the boss 41 of the hand wheel. An additional connection between the hand wheel and the half-wheel is by way of respective parts of the upper and lower flanges of the half-wheel being received in diametrically opposed slots 43, 44 through the part of the boss 41 extending exteriorly of the wall 42. As previously mentioned, the axle which extends between the two end caps will also extend through the spigots 27, and thus, in effect, through each hand wheel. At its end remote from the wall 42, the annular peripheral inner surface of the hand wheel is formed with a multiplicity of V-shaped grooves 45 between respective projections. In the embodiment shown in detail in FIG. 17, each groove is fairly shallow, and in a preferred embodiment of the invention, there are 27 such grooves, each of which, as will be described, defines a location for retention means for holding the rotatable hand wheel relative to the stationary frame, in effect an end cap, when the card wheel has been turned to a desired position. This is necessary, for example, if by reason of the pivotal mounting of the cards on the card wheel, there is a greater mass of cards on the side of the card wheel on which the cards are being lifted. Accordingly if the card wheel is manually turned and then released, the action of gravity on the cards would tend to turn the card wheel in the reverse direction until equilibrium is achieved.

The retention means is shown in FIGS. 12 and 13, and, in this embodiment, is in the form of a flexible strip 46, of polypropylene or other suitable material, which is folded into an inverted-V configuration and pushed into the channel 36 to be held by virtue of the pips, these retention means being provided at at least one end cap. It will be appreciated that the pips 37 are dimensioned and arranged so as to ensure that the strip is tightly held within the channel against any tendency to work loose during relative rotation between the hand wheel and its adjacent end cap. The strip 46 locates against the columns 37*a* so that its outer flat edge lies flush with the outer faces of the ribs 34*a*, 34*b* and of the projection 35, as shown in FIG. 13.

As shown in FIG. 13, the strip is of a length such that when it is inserted in the channel the respective ends of both its limbs extend beyond the outer surface of flange 31, and indeed beyond the boundary defined by the outer surface of the wall section 30. Accordingly, as can be envisaged from FIG. 6, the two free ends of the strip extend to the grooves 45 of the hand wheels, and indeed each limb of the strip is of a length so that it extends into the deepest part of each groove. The angle of the channel, and thus the angle between the limbs of the strip, can be of any suitable value, and thus the number of grooves between the two ends of the strip is not crucial. However generally there would be at least one empty groove, or more likely two or three empty grooves, between the grooves into which the respective free ends of the strip are received in any one 'retained' position of a hand wheel relative to an end cap.

Accordingly it will be appreciated that generally when the rotary card wheel is turned by virtue of one or both of the hand wheels 13, 14, the or each hand wheel will be brought to a position where the respective ends of the strip 46 are received in respective ones of the grooves 45. If movement of the hand wheel is stopped with the respective ends of the strip out of grooves 45, then the resilience/flexibility of the strip may well be such that it will force the hand wheel slightly backwardly or forwardly until the ends of the strip move into the respective nearest grooves, thereby retaining the card wheel in position. When the card wheel is turned to a different position, it will be appreciated that the flexibility/resiliency of the respective ends of the strip are such that these ends will snap/click over the projections, i.e. the raised portions or lands between respective grooves, these ends snapping back into grooves successively until the final adjusted position is reached, as described above.

The invention provides an efficient and effective manner of retaining the card wheel, and thus the cards carried thereon, in a selected viewable position. However the arrangement is also such that the effective retention by way of the strip 46 is nevertheless easily overcome by rotating the manually operable hand wheels until the next desired adjusted position is reached, whereupon the retention means again act securely to hold the hand wheels, and thus the card wheel, in position. It will be appreciated that the number and design of the grooves 45 can be varied as required.

In addition to providing the retention described, the strip 46 also provides a further function which has been found to be desirable with users of rotary card holders, namely an audible indication of the adjustment, in the form of a clicking which accompanies the ratchet action of the respective ends of the strip as they successively move into and out of the grooves 45. In addition to the retention action described, there is thus disclosed a convenient and effective way of providing this clicking noise. However it is to be noted that in alternative embodiments the flexible/resilient means could be arranged to provide only the retention/location, or only the audible indication, with other suitable means providing the other feature.

As well as carrying conventional suitably notched index cards and the like, including dividers, it is also envisaged that in a similar manner the card wheel can carry suitably notched plastics sleeves for holding conventional business cards or the like.

A further feature of the rotary card holder described and illustrated herein is the provision of an identity tag in the form of a (stabilising) foot 47, shown in FIG. 3 only, which is attached to the curved part of the base portion 21 of the frame 18. This foot can be, for example, of transparent or coloured plastics material and can be shaped so as to act as an additional form of support receiving the weight of the holder. It is intended that this foot would bear the name of the manufacturer of the holder or some other identifying information.

It will be appreciated that alternatively the retention means could act between the end cap(s) and the card wheel itself, instead of the hand wheel(s) fitted thereto. Moreover, the retention means could be fitted to the hand wheel(s) or the card wheel, instead of to the end caps.

We claim:

1. A rotary card holder comprising a rotary member mounted by a support assembly for rotation relative thereto and having means for holding a plurality of cards, in use, manually operable means for turning the rotary member, and flexible means, between the support assembly and said manually operable means or said rotary member, the flexible means retaining the rotary member in a position to which it h been turned, in use, by said manually operable means, and including means for producing an audible indication as the rotary member turns, in use.

2. A holder as claimed in claim 1, wherein the manually operable means is a hand wheel non-rotatably fixed to the rotary member.

3. A holder as claimed in claim 2, wherein the hand wheel is at one end of the rotary member, and at its side remote from said one end there is part of said support assembly.

4. A holder as claimed in claim 3, wherein said flexible means act between said hand wheel and said part of said support assembly.

5. A holder as claimed in claim 4, wherein said part of said support assembly is an end cap which protrudes into an outer open side of the hand wheel.

6. A holder as claimed in claim 5, wherein said end cap has said flexible means fitted at an inner side thereof received within said hand wheel.

7. A holder as claimed in claim 2, wherein said flexible means is a material strip.

8. A holder as claimed in claim 1, wherein said flexible means is of polypropylene.

9. A holder as claimed in claim 1, wherein the support assembly comprises a wire frame.

10. A holder as claimed in claim 1, wherein a foot is attached to a part of the support assembly which supports the holder on a surface, in use.

11. A holder as claimed in claim 1, wherein the rotary member is formed with two axially spaced, radially extending annular card holding projections.

12. A holder as claimed in claim 11, wherein the rotary member is formed of two identical half-wheels, which are reversibly engagable so as to provide two different spacings of said card holding projections in said two positions of engagement.

13. A holder as claimed in claim 1, wherein the rotary member is of translucent plastics material.

14. A holder as claimed in claim 1, wherein the manually operable means is of translucent plastics material.

15. A holder as claimed in claim 1, wherein said support assembly includes plastics material end caps at respective opposite ends of said rotary member.

16. A holder as claimed in claim 5, wherein said hand wheel is non-rotatably fixed to said rotary member by a spigot of the rotary member being received in a boss of the hand wheel.

17.A holder as claimed in claim 16, wherein said end cap is non-rotatably fitted onto an end of an axle extending through the rotary member and about which the rotary member is rotatable, in use.

18. A holder as claimed in claim 17, wherein said end of the axle is non-rotatably received in a friction cap which is itself non-rotatably secured in a bore in a hub part of said end cap.

19. A holder as claimed in claim 5, comprising a hand wheel and associated end cap at each end of the rotary member.

20. A holder as claimed in claim 6, wherein the flexible means is fitted in a channel defined in the end cap, with a free end of the flexible means extending out of an open end thereof.

21. A holder as claimed in claim 20, wherein the flexible means fitted in said channel is V-shaped.

22. A holder as claimed in claim 20, wherein the channel is provided with plurality of pairs of spaced pips between which the flexible means is retained.

23. A holder as claimed in claim 22, wherein between each pair of pips is a support column against which the flexible means locates.

24. A holder as claimed in claim 20, wherein the flexible means is a one-piece material strip.

25. A rotary card holder comprising a rotary member mounted by a support assembly for rotation relative thereto and having means for holding a plurality of cards, in use, a hand wheel non-rotatably fixed to the rotary member, for turning it, and a material strip between the support assembly and said hand wheel or said rotary member, the strip having a free end which interferes with projections around an inner periphery of the hand wheel, when the rotary members is turned, in use, by the hand wheel, there by producing an audible indication as the rotary member turns, in use.

26. A holder as claimed in claim 25, wherein said free end of the strip is disposed between a pair of adjacent ones of said projections to retain the rotary means in a position to/which it has been turned, in use.

27. A holder!as claimed in claim 25, wherein the strip is folded into a V-shape to provide two such free ends, which are disposed between respective pairs of adjacent ones of said projections to retain the rotary member in an adjusted position.

28. A holder as claimed in claim 25, wherein each groove defined between an adjacent pair of said projections is of shallow v-shape.

29. A rotary card holder comprising a rotary member mounted by a support assembly for rotation relative thereto and having means for holding a plurality of cards, in use, manually operable means for turning the rotary member, and flexible mean, between the support assembly and said manually operable means or said rotary member, the flexible means retaining the rotary member in a position to which it has been turned, in use, by said manually operable means, and producing an audible indication as the rotary member turns, in use, the support assembly comprising a wire frame having a base part to support the holder on a surface, in use, and respective spaced free ends engaged with end caps non-rotatably secured at the respective opposite ends of an axle extending through the rotary member for rotation of the rotary member relative to said axle, in use.

30. A holder as claimed in claim 29, wherein said free ends of the frame engage in respective openings in annular flanges of the end caps respectively so as non-rotatably to connect the frame and said end caps.

31. A rotary card holder comprising a rotary member mounted by a support assembly for rotation relative thereto and having means for holding a plurality of cards, in use, a hand wheel non-rotatably fixed to the rotary member, for turning it, the hand wheel being at one end of the rotary member and there being at a side of the hand wheel, remote from said one end, part of said support assembly, and flexible means acting between said hand wheel and said part of the support assembly, said part of said support assembly being an end cap which protrudes into an outer open side of the hand wheel, the flexible means retaining the rotary member in a position to which it has been turned, in use, by said manually operable means.

32. A holder as claimed in claim 31, wherein said end cap has said flexible means fitted at an inner side thereof received within said hand wheel.

33. A holder as claimed in claim 32, wherein the flexible means is fitted in a channel defined in the end cap, with a free end of the flexible means extending out of an open end thereof.

34. A holder as claimed in claim 33, wherein the flexible means fitted in said channel is V-shaped.

35. A holder as claimed in claim 33, wherein the channel is provided with a plurality of pairs of spaced pips between which the flexible means is retained.

36. A holder as claimed in claim 35, wherein between each pair of pips is a support column against which the flexible means locates.

37. A holder as claimed in claim 33, wherein the flexible means is a one-piece material strip.

38. A holder as claimed in claim 31, wherein said flexible means is a material strip.

39. A holder as claimed in claim 31, wherein said hand wheel is non-rotatably fixed to said rotary member by a spigot of the rotary member being received in a boss of the hand wheel.

40. A holder as claimed in claim 39, wherein end cap is non-rotatably fitted onto an end of an axle extending through the rotary member and about which the rotary member is rotatable, in use.

41. A holder as claimed in claim 40, wherein said end of the axle is non-rotatably received in a friction cap which is itself non-rotatably secured in a bore in a hub part of said end cap.

42. A holder as claimed in claim 31, comprising a hand wheel and associated end cap at each end of the rotary member.

43. A holder as claimed in claim 31, wherein the flexible means produce an audible indication as the rotary member turns, in use.

* * * * *